US005552205A

United States Patent [19]

Lea

[11] Patent Number: 5,552,205

[45] Date of Patent: Sep. 3, 1996

[54] BATTING FILLED INFLATABLE BODY AND METHOD OF MAKING THE SAME

[75] Inventor: James M. Lea, Seattle, Wash.

[73] Assignee: Cascade Designs, Inc., Seattle, Wash.

[21] Appl. No.: 215,158

[22] Filed: Mar. 21, 1994

Related U.S. Application Data

[62] Division of Ser. No. 895,085, Jun. 30, 1992, abandoned, which is a division of Ser. No. 451,463, Dec. 15, 1989, Pat. No. 5,152,018.

[51] Int. Cl.[6] ..... B32B 1/06; B32B 5/02

[52] U.S. Cl. ..... 428/74; 428/76; 5/420

[58] Field of Search ..... 428/74, 71, 76; 5/420, 450

[56] References Cited

U.S. PATENT DOCUMENTS

| | | | |
|---|---|---|---|
| Re. 31,898 | 5/1985 | Sutter | 428/71 |
| 2,657,716 | 11/1953 | Ford | 5/458 |
| 2,753,573 | 7/1956 | Barker | 5/350 |
| 2,768,420 | 10/1956 | Runton | 428/74 |
| 2,872,690 | 2/1959 | Neisler et al. | 156/292 |
| 3,012,923 | 12/1961 | Slayter | 156/62.2 |
| 3,138,506 | 6/1964 | Ross | 156/156 |
| 3,205,106 | 9/1965 | Cross | 5/458 |
| 3,616,126 | 10/1971 | Tungseth | 5/420 |
| 3,649,405 | 3/1972 | Osborn | 156/292 |
| 3,872,525 | 3/1975 | Lea et al. | 5/348 R |
| 4,025,974 | 5/1977 | Lea et al. | 5/367 |
| 4,115,610 | 9/1978 | Wortman | 428/68 |
| 4,149,919 | 4/1979 | Lea et al. | 156/213 |
| 4,261,776 | 4/1981 | Lea et al. | 156/213 |
| 4,409,271 | 10/1983 | Pehr | 428/71 |
| 4,446,186 | 5/1984 | Rasmussen | 428/74 |
| 4,624,877 | 11/1986 | Lea et al. | 428/71 |
| 4,846,917 | 7/1989 | Härtel et al. | 156/292 |
| 4,906,502 | 3/1990 | Rudy | 428/71 |

FOREIGN PATENT DOCUMENTS

| | | | |
|---|---|---|---|
| 2148401 | 4/1973 | Germany | 5/458 |
| 428129 | 7/1967 | Switzerland | 5/450 |

*Primary Examiner*—Alexander Thomas
*Attorney, Agent, or Firm*—Stephen M. Evans; David L. Garrison

[57] ABSTRACT

An inflatable body comprising an airtight envelope enclosing a core of batting material, having tensile elements extending from upper to lower surface thereof and having the upper and lower surfaces thereof bonded to the envelope.

The process of making the body comprises first laying down two sheets of air impervious film with the core positioned therebetween. The tensile elements are bonded to the sheets. Simultaneously or separately from bonding to the core, the edges of the sheets are sealed together and a valve assembly bonded between or inserted in one of the sheets to allow control of the air volume and pressure within the assembly.

8 Claims, 3 Drawing Sheets

FIG. 5
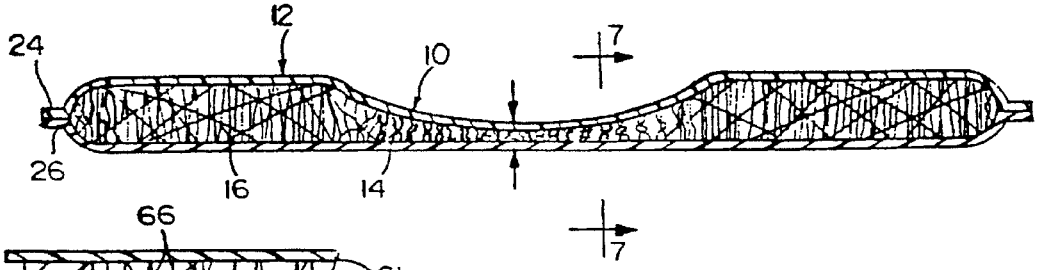
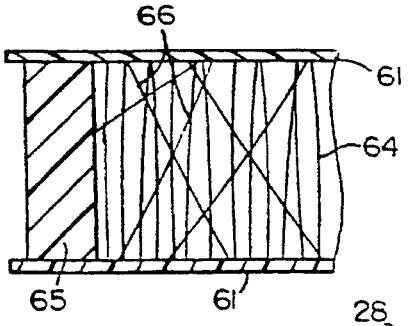
FIG. 6A
FIG. 6
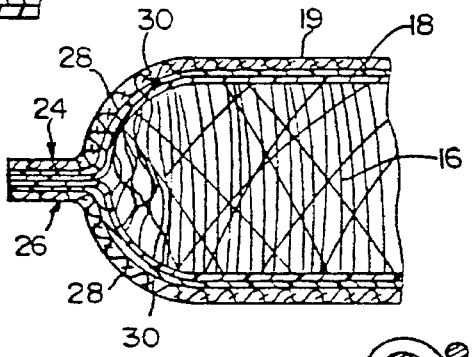
FIG. 9
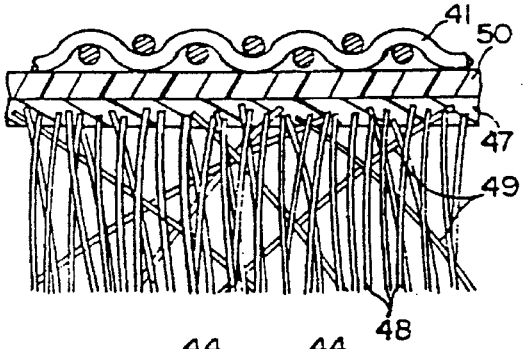
FIG. 7
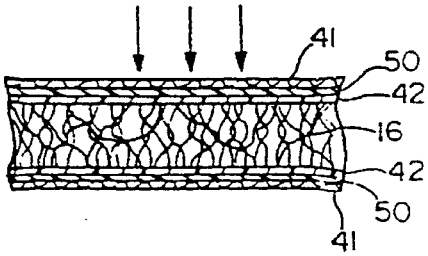
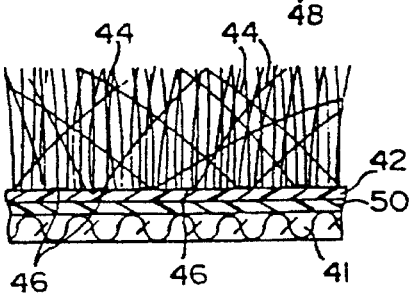
FIG. 8

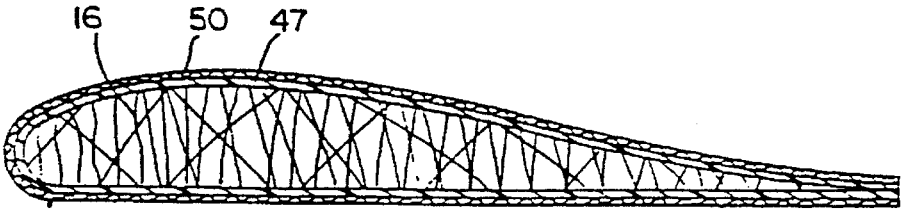
FIG. 10
FIG. 11
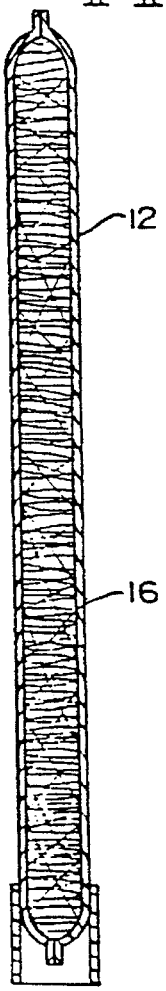
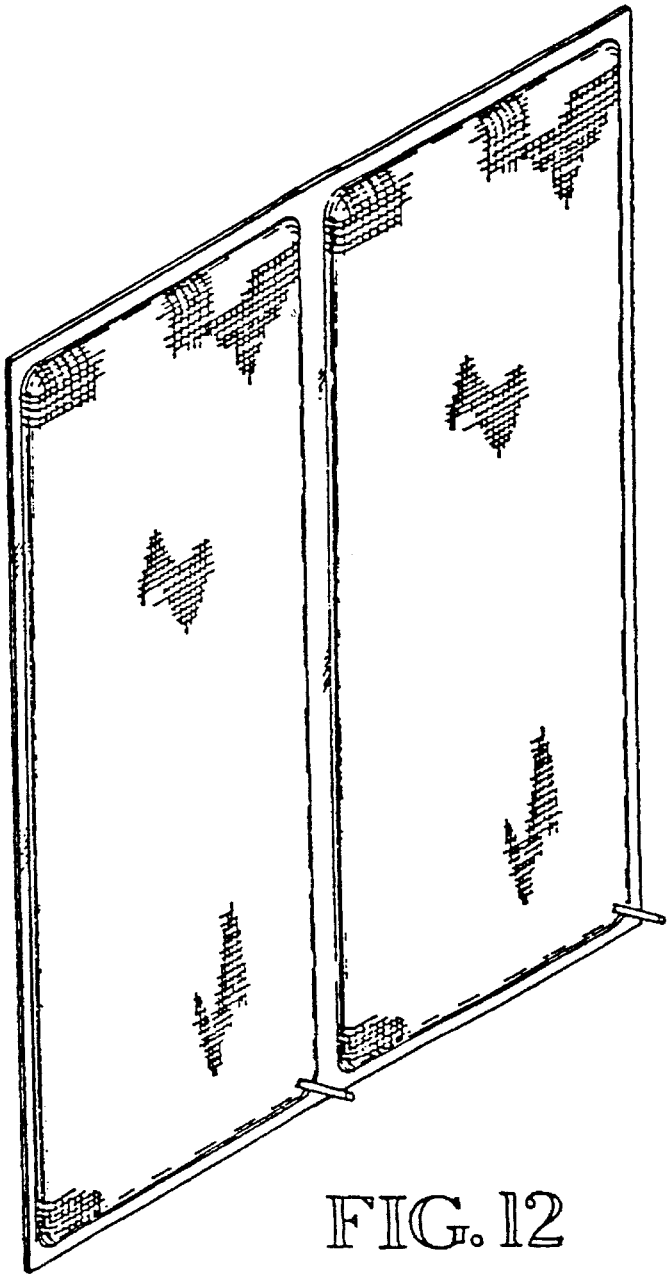
FIG. 12

BATTING FILLED INFLATABLE BODY AND METHOD OF MAKING THE SAME

This is a divisional of application Ser. No. 07/895,085 filed on Jun. 30, 1992 abandoned, which is a divisional of Ser. No. 07/451,463 filed Dec. 15, 1980 U.S. Pat. No. 5,152,018.

TECHNICAL FIELD

The present invention relates to a batting filled inflatable body and a method of making the same. More particularly, this invention relates to inflatable bodies for weight supporting and structural applications, which have internal shape defining elements in the form of tensile members extending across the distance between opposed envelope sheets and defining the distance therebetween.

BACKGROUND INFORMATION

It is well known to use inflatable bodies as weight supporting structures such as for air mattresses used by campers and backpackers. Inflatable structural shapes are also known which have opposed sheets of an air impervious envelope fastened together by a plurality of threads extending across the air space, with the threads woven into the fabric of the airtight envelope. Structural shapes of this description are shown in U.S. Pat. No. 3,138,506. Inflatable air mattress structures having a flexible foam core enclosed within and adhered to an airtight flexible jacket are shown in U.S. Pat. Nos. 3,872,525; 4,025,974; 4,149,919; 4,261,776; and 4,624,877. These patents, while showing a relatively lightweight air mattress, teach devices which must include a foam core which inherently adds appreciably to the weight of the device, a serious detriment for backpackers. In addition, the cost of the foam core contributes significantly to the cost of the device.

SUMMARY OF THE INVENTION

It has been discovered that cushioning and pressurized inflatable bodies can be manufactured by substituting batting similar to that used in quilting and pillow applications, instead of foam or threads woven into the fabric, but with the batting fibers oriented so that tensile elements in the form of fibers, composite fibers, loops or spirals generally extend across the major dimension of the body. With this orientation of the tensile elements in the batting the tensile elements may be bonded to the inner surface of the airtight envelope. One method of effecting this bond is by using sheets with a heat activated or heat softened inner layer. Heat is applied to the air holding and bonding sheets of the envelope while the sheets engage and compress the batting. Other means of effecting a bond such as solvent-based adhesives, may also be used. During manufacturing the sheets will become securely bonded to the tensile elements. When the edges of the sheets are bonded together to make an airtight envelope and when a porting means is provided to the envelope, the inflatable body can have a controlled amount of air provided therein. By providing envelope sheets having the desired dimensional stability and flexibility, the assembly exhibits cushioning for use as an air mattress or, with higher inflation pressure, sufficient rigidity for use as a structural member. The structural requirements are provided by the sheet characteristics, the tensile elements and the gas pressure within the body.

One embodiment of the inflatable body using the present invention which is particularly useful for cushioning, as in an air mattress, comprises an air impervious closed envelope made of a flexible material, and having top and bottom sheets joined to one another in an air tight seal about the peripheral portions thereof. A valve for inflating and deflating is mounted upon the envelope to permit air to enter and leave as desired by the user. Positioned within the envelope is a resilient batting core having a substantially planar configuration, with length and width dimensions substantially in excess of its thickness dimension. The batt material is characterized in that it has a density no greater than about 5 pounds per cubic foot and desirably no greater than about 1 pound per cubic foot, with the preferred range being between about 0.1 to 1 pound per cubic foot. The batt core material has a 25% ILD (Indentation Load Deflection, when tested in a procedure similar to ASTM test D3574 for cellular materials) of no greater than about 50 pounds, and desirably in the range of 1 to 30 pounds.

The batt core is substantially continuous throughout the envelope with tensile elements such as fibers or composite fibers extending across the thickness thereof. With the batt positioned horizontally, the entire upper and lower surfaces of the batt core, especially the ends of the fibers which extend across the core, are securely bonded to the upper and lower sheets of the envelope. This enables the batt fibers to act effectively in tension between the upper and lower sheets to limit deflection of the upper and lower sheets away from each other so that when the envelope is loaded as by a person lying or sitting on the envelope, sufficient air pressure is maintained within the envelope when the valve is closed to support a localized load on the inflatable body. The batt has compression characteristics such that, when the valve is open, the inflatable body can be easily deflated and rolled into a compact stowed position, whereupon the valve should be closed. The body will remain in that stowed position as long as the valve remains closed. When the valve is opened, the batt will gently urge the sheets of the envelope apart to provide a self-inflating capability for the body which will suck air through the valve into the batt core.

The perimeter of the inflatable body is formed in a seam joint, where the upper and lower sheets are joined one to another preferably in face to face relationship at their inner surfaces to form a peripheral bonded edge portion. A box configuration may also be utilized. The proximate portions of the upper and lower sheets extending from the bonded edge portion extend from the seam to a substantially parallel central zone, in a rounded transition similar to that shown in U.S. Pat. No. 4,025,974. The fibers of the batt maintain the major portions of the upper and lower sheets separated by the length of the fibers, many of which lie in a substantially parallel relationship when the inflatable body is filled with air. By altering the length of the fibers in diverse areas of the structure, a contoured surface configuration can be attained by the inflatable body upper and lower sheets.

The sheet material which finds use as the upper and lower sheets or envelope of the inflatable body may be composed of one or more layers, the sheets each providing the functions of a receptor and anchor for the ends of the tensile elements in the batt material forming the core of the body as well as providing the air impervious barrier which will survive the manufacturing process, and the desired tensile and flexural characteristics to form the inflatable body.

For proper bonding of the batt material to the sheets, the receptor or anchor layer of the sheets may be composed of an appropriate thermoplastic or adhesive material, or have at least one layer of a thermoplastic or adhesive material having a lower softening or activating temperature than the outer layer or layers. There may additionally be an intermediate air impervious layer of a plastic material, which is either thermosetting or is a thermoplastic material with an appreciably higher melting temperature than the inner layer. The thermoplastic or adhesive material may be used both to form the peripheral bond around the body and to bond the fibers in the batt to the sheets or a separately applied adhesive may be provided for either or both the peripheral and batt seal if desired. Heated air or a flame impinging upon the batt and sheet may serve to soften the sheet layer and tips of the fibers so that a bond with the fibers may be attained.

In one process of the present invention, a pre-bonding assembly is formed by placing a planar piece of batt material between upper and lower air impermeable sheets, each having an appropriate thermoplastic composition or adhesive surface thereon. A valve housing is positioned in one sheet or between the sheets at a convenient location, so as not to interfere with the tension carrying ability of the batt. The pre-bonding assembly may be simultaneously heated and compressed so as to compress the batt core between the sheets and soften the bondable surface of the sheets to permit proper engagement and bonding thereof with the batt and to permit bonding of the perimeter of the sheets, one to the other, and to the valve housing. The sheets are then cooled or otherwise allowed to cause a secure bonding of the assembly. The bonding of the sheets to the batting and the bonding of the peripheral seal may be done simultaneously or in separate steps.

In the preferred form of the process of the present invention for an air mattress, the edge portions of the sheets of the pre-bonding assembly are fastened in a perimeter frame to form a frame and mattress assembly, which is then placed between heated platens. At least one of the platens (and desirably both of the platens) has a raised peripheral shoulder surrounding the main pressure surface of the platen to engage edge portions of the two sheets adjacent the edge of the batt material. The two platens are initially brought together to compress the batt material between the sheets, to press the edge portions of the sheets together, and to press the edge portions to a valve housing placed between the edge portions of the sheets for the bonding operation. The peripheral seal may be done in a subsequent step if desired.

A vacuum may be applied through the valve housing to maintain the edge seals together and to engage the batt with the thermoplastic or adhesive while the heated platens are moved apart to maintain the parts of the mattress assembly in contact, and the frame assembly is subjected to cooling. The cooling step is conveniently accomplished by momentarily dipping the entire frame and mattress assembly edgewise into a water tank, by spraying water onto both sides of the assembly or by other well known methods of cooling.

Immediately after, or during the later stages of the cooling step, air may be introduced through the valve housing of the assembly to moderately pressurize the interior of the assembly (e.g. to about 2 psi). This breaks unwanted weaker bonds and applies an extension load to the fibers in the batt to enhance extension set or loft of the batt, thereby tending to straighten the individual fibers bonded to both sheets.

For structural applications of this invention, higher pressures may be utilized within the body with appropriately strong batting fibers in the core and with upper and lower sheets having appropriate strength structure and flexure characteristics. Airfoils, structural beams and panels and a myriad of other shapes may be configured by use of this invention with appropriate variations in the length of the core fibers at diverse locations in the structure.

Resistance to shear loading may be enhanced in either the air mattress or structural application of this invention by using batting with relatively more random fiber direction so that fibers extending diagonally between the sheets will resist shear loads.

Another important function of the batting core in either the mattress or structural body is the insulating value of the batting rendered by limiting convective heat transfer between the sheets. The insulation characteristics may be varied for different bodies formed according to this invention or at different locations within such a body, as desired by altering the density of the batting core used from one body to another or at various locations within such a body.

BRIEF DESCRIPTION OF THE DRAWINGS

FIG. 5 is a view similar to FIG. 3, but showing the inflated body under compression at the middle portion thereof, as in the situation where a person is resting on the inflatable body and showing the unloaded areas of the body with the batt fibers in tension.

FIG. 6 is a fragmentary sectional view, drawn to an enlarged scale, detailing the structure of the batt and the body envelope at the edge portion of the body.

FIG. 6(*a*) is a fragmentary cross-sectional view of an alternate edge configuration used to form a box construction with rigid or non-rigid sheets.

FIG. 7 is a partial transverse sectional view, drawn to an enlarged scale taken along lines 7—7 of FIG. 5 and detailing the compression and flexing of the batt fibers when supporting a weight such as a person sitting or reclining thereon.

FIG. 8 is an enlarged partial transverse sectional view of the batt-sheet interface using a multiple layer sheet, showing engagement and bonding of fiber to the surface of the adhesive layer.

FIG. 9 is a further enlarged sectional view in which the bonding of the fiber ends is shown by the fibers penetrating partly into the adhesive layer to ensure a bond.

FIG. 10 shows a cross section of a foil embodiment of the invention wherein the batt material has been shaped to provide a desired foil contour.

FIG. 11 illustrates the embodiment of FIG. 3 but wherein the body is vertically located in a stand to permit the invention to be used as a panel.

FIG. 12 is a perspective view of the panel embodiment of FIG. 11.

DESCRIPTION OF THE PREFERRED EMBODIMENT

It is believed that a clearer understanding of the present invention will be attained by first describing the main components and physical details of the cushioning or weight supporting type inflatable body or air mattress, as characterized by the present invention and then analyzing how these main components interact to provide adequate support for a load on the inflatable body. More specifically, the manner in which the force of the weight of the load acting downwardly on the inflatable body is transmitted into the inflatable body structure and resisted thereby will be analyzed with regard to the tension and compression characteristics of the batt and envelope sheets or skins and the manner in which these interact in the structure of the inflatable body to counteract the forces of the load.

Figure 1:
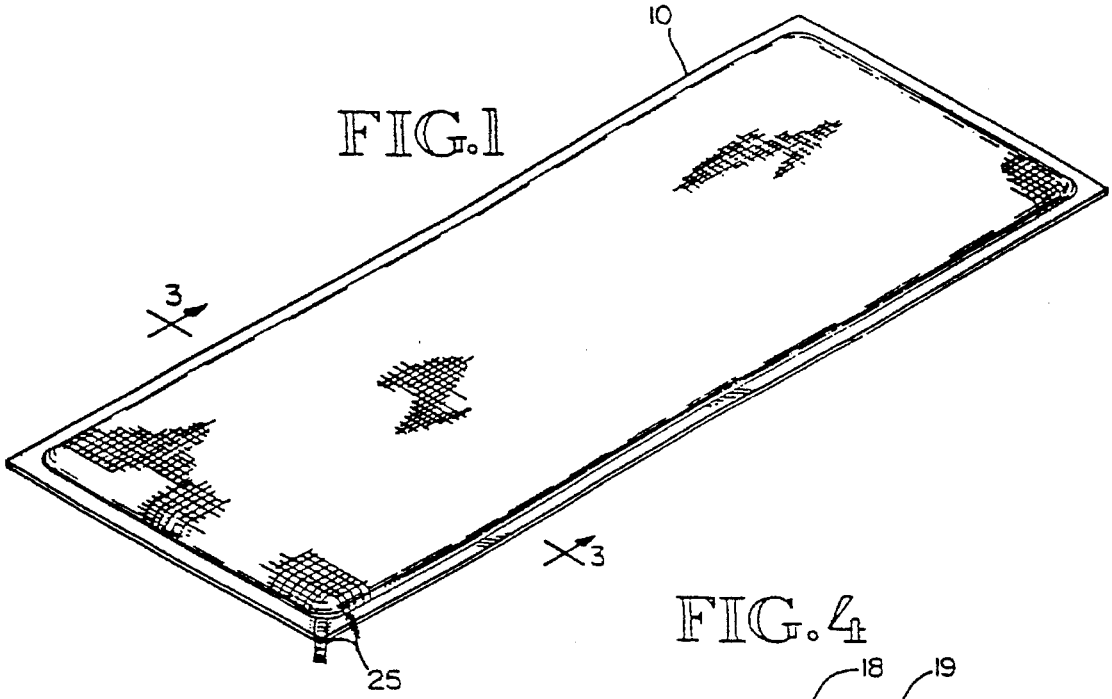
FIG. 1 is an isometric view of a cushioning type body or air mattress in inflated condition using the present invention.
Figure 4:
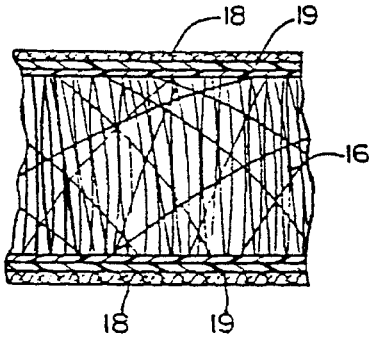
FIG. 4 is a partial transverse sectional view of another embodiment of this invention drawn to an enlarged scale, and detailing the manner in which the batt core is bonded to the sheets of the envelope.

Referring specifically to the drawings wherein like numerals indicate like parts there is seen the inflatable body 10 of the present invention in an embodiment having a fiat, rectangular configuration, comprising upper skin 12 and lower skin 14, which are bonded one to another about their entire periphery to provide an air impervious envelope enclosing a core 16. Core 16 is composed of a lightweight, resilient batt material having tensile elements such as fibers or composite fibers generally extending across from upper skin 12 to lower skin 14, many of which extend at substantially right angles from the skin surfaces to define the separation therebetween, but at least some of which are at other angles to add lateral stability to the structure as desired. FIG. 1 shows a perspective view of an inflatable air mattress 10 having a vane structure 25 through which air passes to inflate or deflate the mattress structure for use or carrying, as well as storage. The same mattress 10 is shown rolled, in FIG. 2, with the air removed therefrom, providing a convenient, small and eminently portable mattress structure, which self inflates when the air valve is opened or may be additionally pressurized, as is more specifically described below. As shown in FIGS. 3 and 4, each of the skins 12 and 14 may be comprised of a film or coated fabric air impervious layer 18 to which the batt core 16 can be bonded directly as in FIGS. 3 and 5 or with a layer 19 as in FIGS. 4 and 6–9, layer 19 is preferably a thermoplastic or other adhesive material. As noted, both single layer and multiple layer skins are contemplated.

The batt material which makes up the core 16 is preferably a low density, resilient batt, desirably made of polyester, polypropylene, nylon or other suitable fibers. Its density is desirably no greater than about 5 pounds per cubic foot, and preferably in the range of 0.5 to 1.2 pounds per cubic foot, with batts of a density as low as 0.1 pound per cubic foot also being usable, depending upon the composition, resiliency and other properties of the fibers in the batt. The batt is preferably one which is formed from spun fibers which are generally oriented lengthwise within the batt structure. In one method of assembling the batt, the fibers generally extend parallel to the run or major dimension of the batt. This batt construction is common for insulating and cushioning batt material such as is used in a quilt or pillow. Short segments of the batt are severed, the length being about equivalent to the desired thickness of the resulting core structure. These severed batt sections are then turned 90 degrees and assembled side by side so the core 16 has a significant number of filaments extending between the upper surface and the lower surface thereof. A batt of thickness dimensions such that a single segment, rather than a series of thinner sections may be used to form the complete core, is also contemplated.

The edge joint or seal 24 at which the two skins 12 and 14 are joined about their entire perimeter is made by bonding the two inner surfaces of the skins 12 and 14 to form a "T" joint or seam as shown in FIGS. 3, 5 and 6. There is a valve 25 which may comprise a thermoplastic housing and a conventional valve member mounted therein.

With the main components of the inflatable body described, the manner in which this body 10 performs its supporting function will now be analyzed with particular reference to FIGS. 5, 6 and 7. The basic function of an inflatable body used for cushioning or support such as an air mattress is to support all, or substantially all, of the load on the inflatable body upper surface, which then transmits the load to the underlying support surface below. It is important that the support provided keeps all or nearly all of the load from compressing the batt so as to directly touch the support surface through the inflatable body and must therefore transfer the load and provide an upward force against the weight equal to the downwardly directed force caused by gravitational forces. The upper surface of the inflatable body conforms reasonably to the contours of the load so that supporting forces are distributed over an adequate area of contact with the load. Thus, the force of the weight of the load increases the air pressure within the body such that those portions of the body where the tensioning fibers are unloaded can transfer the load through the pressurized air and through the lower sheet to the underlying surface. The compression of the batt fibers in the compressed part of the body also exerts some force to support the load.

The present invention, when used as a cushioning and weight supporting body such as an air mattress, usually utilizes a batt having a density no greater than about 5 pounds per cubic foot, and desirably in the order of 0.5 to 1.2 pounds per cubic foot, or even possibly less. The 25% ILD of the batt, as mentioned earlier herein, should be no greater than 50 pounds and desirably in the range of 1 to 30 pounds.

It is noted that an essential feature of the presently preferred embodiment of this invention is that individual tensile elements of the lightweight batt core 16 be bonded both to the upper skin 12 and lower skin 14 over substantially the entire horizontal surfaces thereof. In some instances of batt construction, shorter fibers may be present which span only a part of the distance between sheets but which fibers are bonded to adjacent fibers with adhesives used in the batt construction to form a structure or link providing a tensile element spanning and defining the distance between the sheets. Other configurations may have batting in only parts of the sheets according to the desired body performance. Contrary to the tearing characteristics of polyurethane foam, filament strength can be much higher than foam strength and discontinuous bats may be used and meet special design requirements.

Structural bonding is not required at the extreme edge areas of the batt and envelope for the embodiments of this invention shown in the various drawings. For a box-type structure, having vertical rather than rounded edge and end walls, it may be desirable to have bonding of the batt core extend to the periphery of the body. Other structures and bodies are contemplated wherein the core is not bonded, at all in certain zones of the body, permitting the top and bottom sheets to assume the shape dictated by air pressure and adjacent bonded areas. Further, it is noted that the horizontal dimensions of the inflatable body are quite large relative to the thickness dimension of the core 16, which is about 1.5 inches for one configuration of a self inflating or inflatable mattress. Bonding the ends of the fibers of the batt to the upper skin 12 and lower skin 14 restricts the distance which may separate the upper and lower skins. When a localized weight is applied to the upper skin 12 as shown in FIGS. 5 and 7, the air pressure inside the mattress increases. Due to the depression of the upper skin 12, fibers in the batt are bent as is schematically represented in FIG. 7. Resiliency of the individual fibers permits distortion and bending, yet because of the endwise bonding of the individual fibers, as discussed above, the resiliency of the fibers tend to urge the skins 12 and 14 apart, with the increased air pressure in the enclosed space providing the primary support to the upper sheet and its load. As the weight on the upper skin 12 increases, the pressure throughout the mattress increases. Due to the bonded fibers anchored to and extending across the gap between the skins 12 and 14, the skins cannot separate beyond the condition shown in FIG. 3. Accordingly, the weight placed upon the upper skin 12 is supported and the load is transmitted to the support surface below by the increased pressure of the air within the batt.

As mentioned above, the fibers in the batt 16 also perform the function of urging the upper skin 12 and lower skin 14 apart, providing a self inflating feature to the inflatable body. The presence of batt 16 within the body also provides the important function of restricting air circulation, thereby allowing the stagnant air to insulate the user so that a warm and comfortable air mattress is provided. Air may be added to pre-load the fibers or to provide additional support as needed.

Attention is now directed to FIG. 6 which shows the construction of the edge portion of the body 10. The upper and lower sheets 12 and 14, as indicated previously, are joined together in an air tight seam at joint 26, such that the interior surfaces of the edge portions of the sheets 12 and 14 are bonded together. When the interior of the body 10 is pressurized, as in the case of a load on the body 10, the increase in pressure pushing outwardly against the portions of the skin sections 12 and 14 immediately adjacent the joint 26 causes the sheets to be placed under tension and to curve into a configuration having a cross section similar to an unsupported inflated skin where pressure is resisted only by tension in the skin. These sections are indicated at 28 in FIG. 6. At the areas where these skin sections 28 each begin their inward curve toward the joint 26, the adjacent section of batt, indicated at 30, is actually compressed by the adjacent skin portions. Thus, in that particular area it is not essential to obtain a strong bond between the batt 16 and the adjacent skin sections, since this particular joint construction alleviates the tendency for that area of the skin section to pull apart from the batt.

This is particularly significant in accomplishing reliability of structure, since there is a tendency, in the circumstance where a small area of non-bonding or delamination occurs in an area where the skin is tensioned outwardly, for this delamination to spread progressively, even under moderate pressure, because the air pressure in the body acts uniformly to load the skin, while the load must be resisted by tensile strength of the skins and fibers.

In FIG. 6(*a*) a box-type edge construction is shown. Sheets 61, which may either be flexible or rigid, are shown bonded to spacer or edge piece 65. Spacer 65 may also be flexible or rigid, depending upon the application intended for the body. Tensile elements 64 are shown adhered to and extending perpendicular from sheets 61 while other fibers 66 are shown at random positions and may be attached to sheets 61 and spacer or edge piece 65.

Figure 2:
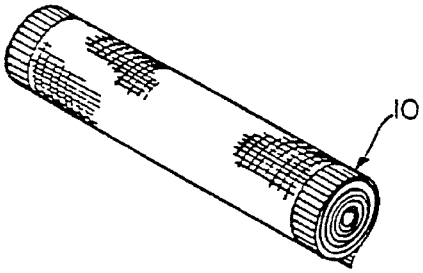
FIG. 2 is an isometric view of the same body as shown in FIG. 1 in its compressed and rolled condition for storage or convenient carrying.
Figure 3:
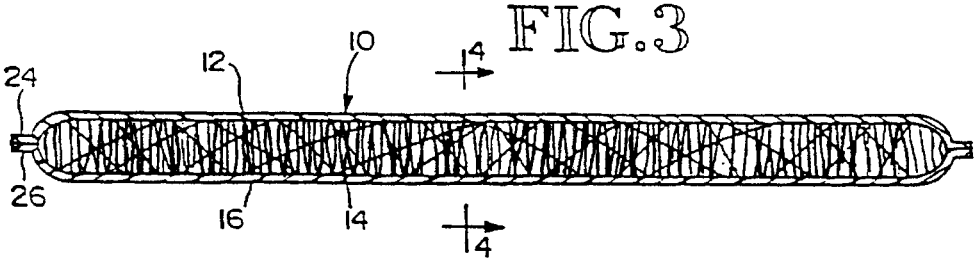
FIG. 3 is a transverse sectional view taken along line 3—3 of FIG. 1, showing a single layer top and bottom sheet configuration.

In use, the inflatable body 10 is usually initially stored in a rolled up, stowed position, as is shown in FIG. 2. To prepare the inflatable body or air mattress for use, valve 25 is opened, permitting air to enter the structure. With the batt "remembering" its unloaded shape, the body unrolls into the flat opened position generally shown in FIG. 1, and the straightening forces of the fibers in the core urge the upper skin 12 and lower skin 14 apart due to the plastic memory of the filaments in batt 16. The skins 12 and 14 are urged apart thereby drawing air into the interior of the mattress body until the condition shown in FIG. 3 is obtained, wherein the upper skin 12 lies substantially parallel to the lower skin 14 separated by the now more or less extended and straightened fibers in batt 16. The valve 25 may then be closed to trap the air within the inflatable body or optionally, the amount of air within the body may be increased by mouth or other air source. For a normal load condition, the amount of air present within the batt after self-inflation is usually adequate to support the load on the inflatable body.

Once valve 25 is closed, any load applied to the upper skin 12 of mattress 10 will result in a deflection of skin 12 and a corresponding increase in pressure throughout the-mattress body. Since the skins 12 and 14 may not be separated by more than the length of the fibers imbedded at each end in the adhesive material 18, the pressure increases in the body until the downward force shown at the arrows in FIGS. 5 and 7 is counteracted by an equal and opposite upwardly directed force provided by the air pressure.

The skins must also provide an important function of resisting stretching to resist the air pressure and keep the batt from being stretched horizontally. This tensile strength of the skins can be varied to provide the desired firmness or softness of the mattress assembly. FIGS. 8 and 9 shows fabric layer 41 which prevents stretching of the sheet. Fabric layer 41 is a coated fabric such as 200 denier nylon oxford or other fabric with desired strength, smoothness and flexural characteristics.

With proper selection of the batting material used in manufacturing the core 16, the resiliency characteristics of the batting can be such that the batting will tend to recover its original extended configuration providing a self-inflating characteristic for the inflatable body. In FIGS. 8 and 9 two configurations of the bond and attachment of the fibers to the sheets are shown in detail. FIG. 8 shows various of the fibers adhered to the surface of the adhesive layer 42, with certain fibers 44 angled with respect to the adhesive surface 42 attached along a short length, as at 46. Other fibers 43 are shown attached at their ends to adhesive layer 42. In FIG. 9 the fibers are shown inserted or thrust into adhesive layer 47, including both the fibers 48 which are perpendicular to adhesive layer 47 and the non-perpendicular fibers 49. Air impervious layer 50 in both embodiments supports the adhesive layers 42 and 47 and are in turn attached to fabric layer 41.

To form the body shown in FIGS. 3 and 5, wherein a single layer sheet is used, a method of heating and activating the sheet surface by flame or hot air impingement may be utilized, to soften or degrade the surface so that the tensile elements and other fibers in the batt will become adhered to the layer. A bond with the batt similar to that shown in FIG. 8 will then occur when the activated surface and the batt are brought into contact. The resulting structure is then bonded around the periphery to form the air impervious envelope with the batt core inside.

For use as an air mattress, this configuration of pad has lighter weight, lower cost and allows greater compaction than current polyurethane foam filled mattresses and also has adequate insulating value.

When used as a structural member such as a column, wall as shown in FIGS. 11 and 12, roof, airfoil as shown in FIG. 10 or other lightweight shape, the internal pressure may be increased for rigidity or as when used as walls, where no load support will be required, the air pressure may be decreased as desired. In structural applications, the combined attributes of the air impervious layers, the shape dictating fiber batt length and the insulating properties combine in a low-cost structural element. Clothing and bedding which have controllable insulative and inflation properties are contemplated. Examples of such applications are the survival suits widely used in cold climates on board ships and vessels, other types of outerwear and bedding such as quilts and sleeping bags where controllable and variable insulative and bulk parameters are desired.

INDUSTRIAL APPLICABILITY

The apparatus described in this invention finds industrial applicability in the area of light weight, self-inflating mattresses, particularly useful for backpacking and the like. A growing area of application for the device described herein include the health industries in which mattress are provided for x-ray tables, for bedridden patients and for devices such as wheelchairs wherein a light weight yet positively supportive mattress or cushion structure is desired. The exceptional insulating characteristics of this light weight mattress structure further enhances comfort and usability of the device in various applications. Insulation value may also be chosen by selecting appropriate size and number of fibers in the batt. The methods of manufacturing the device find applicability in the manufacture of self-inflating mattress and pad structures, such as are used in applications mentioned above, which is now provided by foam-filled or thread-supported rather than batt-filled structures.

For structural applications wherein an extremely lightweight yet relatively rigid support panel, column, airfoil, roof panel, wall element or other element is desired, a device using the invention disclosed herein may be used and the desired rigidity provided by selecting appropriate inflation pressure. The exceptional insulating properties of devices incorporating this invention suggest applications in the clothing and survival gear fields. Building panels, tent walls, including self erecting structures, clothing and bedding are also contemplated.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

What is claimed:

1. An inflatable body comprising:

(a) an air impervious envelope having first and second sheets of substantially flexible and non-stretchable material joined to one another at perimeter portions thereof and defining a chamber, said first and second sheets each having an interior and exterior surface;

(b) a valve mounted to said envelope to permit air ingress to and egress from said chamber;

(c) a resilient, fiber batt core positioned within said chamber, said core having a planar configuration with first and second batt surfaces, having length and width dimensions substantially in excess of its thickness dimension, and having tensile elements extending from said inner surface of said first sheet to said inner surface of said second sheet to define the separation therebetween, the resiliency of said tensile elements causing said tensile elements to straighten and thereby urge said first and second sheets apart until said tensile elements are fully extended, thus preventing further separation thereof, said batt core being substantially continuous throughout said chamber and having said first and second surfaces thereof securely bonded to said first and second sheets of said envelope with a bonding strength adequate to resist tension forces imparted by internal air pressure resulting from compression loading on the body.

2. The inflatable body of claim 1 wherein said core comprises fibers extending between and securely bonded at respective terminal ends thereof to first and second sheets of said envelope, whereby said first and second sheets are separable by a maximum distance defined by the length of said fibers.

3. The inflatable body of claim 2 wherein a portion of said fibers are of substantially equal length and extend at substantially right angles relative to said first and second sheets.

4. The inflatable body of claim 2 wherein said fibers vary in length at diverse locations of the body to provide a contoured surface.

5. The inflatable body of claim 1 wherein said tensile elements have elastic memory such that when compressed, urge said first and second sheets apart, thereby making the body self-inflating as well as inflatable.

6. The inflatable body of claim 1 wherein said sheets each comprise a single layer to which said tensile elements are bonded.

7. The inflatable body of claim 1 wherein said sheets each comprise a plurality of layers, the innermost of which is a heat softenable thermoplastic into which said tensile elements are bonded.

8. The inflatable body of claim 1 wherein said batt includes randomly oriented fibers, at least some of which extend between said first and second sheets forming said tensile elements.

* * * * *